US009677512B2

(12) United States Patent
Dudar et al.

(10) Patent No.: US 9,677,512 B2
(45) Date of Patent: Jun. 13, 2017

(54) SYSTEMS AND METHODS FOR REDUCING BLEED EMISSIONS

(71) Applicant: Ford Global Technologies, LLC, Dearborn, MI (US)

(72) Inventors: Aed M. Dudar, Canton, MI (US); Dennis Seung-Man Yang, Canton, MI (US); Russell Randall Pearce, Ann Arbor, MI (US); Mohammad R. Aghili, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 133 days.

(21) Appl. No.: 14/699,225

(22) Filed: Apr. 29, 2015

(65) Prior Publication Data

US 2016/0319776 A1 Nov. 3, 2016

(51) Int. Cl.
*F02M 25/08* (2006.01)

(52) U.S. Cl.
CPC .... *F02M 25/0818* (2013.01); *F02M 25/0809* (2013.01); *F02M 25/089* (2013.01); *F02M 25/0836* (2013.01); *F02M 2025/0845* (2013.01)

(58) Field of Classification Search
CPC ..... F02M 25/0836; F02M 25/0818; F02M 25/0809; F02D 41/004
USPC ..... 123/519, 520, 518, 516, 198 D, 698
See application file for complete search history.

(56) References Cited

U.S. PATENT DOCUMENTS

| | | | | |
|---|---|---|---|---|
| 5,637,788 | A | 6/1997 | Remboski et al. | |
| 7,219,660 | B2 | 5/2007 | Amano et al. | |
| 2003/0226549 | A1* | 12/2003 | Takagi | F02M 25/0818 123/520 |
| 2004/0149016 | A1* | 8/2004 | Kano | F02M 25/0818 73/40 |
| 2005/0072221 | A1* | 4/2005 | Itakura | F02M 25/08 73/114.41 |
| 2013/0096757 | A1* | 4/2013 | Fukui | F02M 25/0809 701/22 |
| 2013/0152905 | A1 | 6/2013 | Woods et al. | |
| 2014/0013944 | A1* | 1/2014 | Haag | F02M 25/0818 95/146 |
| 2014/0069394 | A1 | 3/2014 | Jentz et al. | |
| 2015/0090235 | A1* | 4/2015 | Pearce | F02M 25/0836 123/520 |
| 2015/0198123 | A1* | 7/2015 | Pearce | B60K 15/03504 123/520 |

(Continued)

OTHER PUBLICATIONS

Anonymous, "A Method to Reduce EVAP Bleed Emissions in HEV Vehicles," IPCOM No. 000237774, Published Jul. 10, 2014, 2 pages.

*Primary Examiner* — Mahmoud Gimie
(74) *Attorney, Agent, or Firm* — James Dottavio; McCoy Russell LLP

(57) ABSTRACT

A method for a fuel system is provided. A vacuum is applied to a fuel vapor canister side of the fuel system, and hydrocarbon breakthrough is indicated responsive to a fuel vapor canister side pressure inflection point indicative of a decay in fuel vapor canister side vacuum. In this way, an evaporative leak check module may perform a leak check on a fuel vapor canister, while hydrocarbon breakthrough from the fuel vapor canister may be indicated without requiring a dedicated hydrocarbon sensor in the canister vent line.

19 Claims, 6 Drawing Sheets

(56) References Cited

U.S. PATENT DOCUMENTS

| | | | | |
|---|---|---|---|---|
| 2015/0285171 | A1* | 10/2015 | Dudar | F02M 25/0836 73/114.39 |
| 2016/0053726 | A1* | 2/2016 | Dudar | F02M 25/089 123/520 |
| 2016/0084175 | A1* | 3/2016 | Dudar | B60K 15/03504 123/521 |

* cited by examiner

SYSTEMS AND METHODS FOR REDUCING BLEED EMISSIONS

FIELD

The present description relates generally to methods and systems for performing evaporative emissions leak testing of a fuel system.

BACKGROUND/SUMMARY

Vehicles sold in North America are required to adsorb refueling, diurnal and running loss vapors into a carbon canister. When the canister is loaded with fuel vapor, the contents may be purged to engine intake using engine intake vacuum to draw fresh air though the canister, desorbing bound hydrocarbons. Strict regulations regulate the performance of evaporative emissions systems.

As such, evaporative emissions systems must be periodically subject to on-board testing for leaks and other forms of degradation that could increase emissions. In hybrid vehicles, and other vehicles configured to operate in engine-off or reduced manifold vacuum modes opportunities to test for leaks using manifold vacuum may be infrequent. As such, an additional vacuum source is required for leak testing evaporative emissions systems in these vehicles. In some examples, a vacuum pump is placed between the fuel vapor canister and atmosphere.

However, such vehicles also have infrequent opportunities to purge the fuel vapor canister to the intake of the engine. Subsequently, if a leak test is applied to the fuel vapor canister while it is saturated with fuel vapor, hydrocarbon breakthrough may occur and result in bleed emissions as well as false leak detection. Hydrocarbon breakthrough may be detected by a dedicated hydrocarbon sensor, as shown in U.S. Patent Application 2013/0152905, but this adds significant manufacturing costs to the vehicle.

In one example, the issues described above may be addressed by a method for a fuel system, comprising applying a vacuum to a fuel vapor canister side of the fuel system, and indicating hydrocarbon breakthrough responsive to a fuel vapor canister side pressure inflection point indicative of a decay in fuel vapor canister side vacuum. In this way, an evaporative leak check module may perform a leak check on a fuel vapor canister, while hydrocarbon breakthrough from the fuel vapor canister may be indicated without requiring a dedicated hydrocarbon sensor in the canister vent line.

As one example, a pressure inflection point may lead to the cessation of applying vacuum to the fuel vapor canister side of the fuel system, thus preventing hydrocarbon breakthrough. Further, the leak test may be revisited once the fuel vapor canister has been purged. In this way, the leak test may occur without risk of false failures due to hydrocarbon breakthrough.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
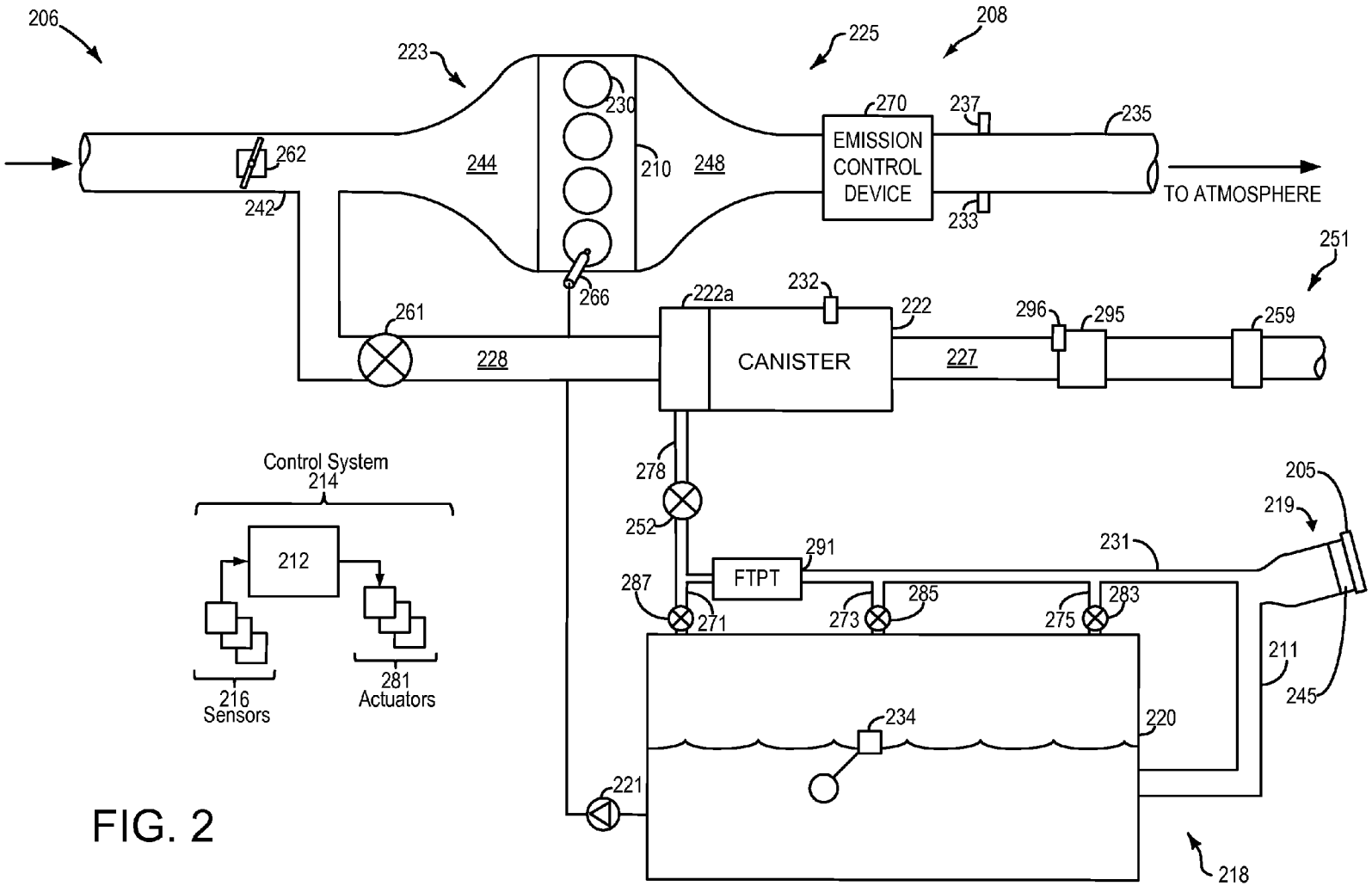
FIG. 2 schematically shows an example vehicle system with a fuel system and an evaporative emissions system.
Figure 3A:
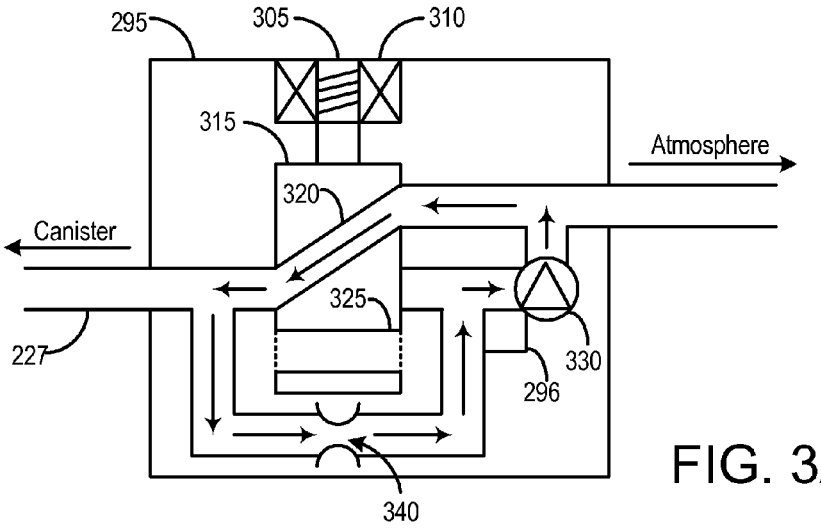
FIG. 3A shows a schematic depiction of an evaporative leak check module in a configuration to perform a reference check.
Figure 3B:
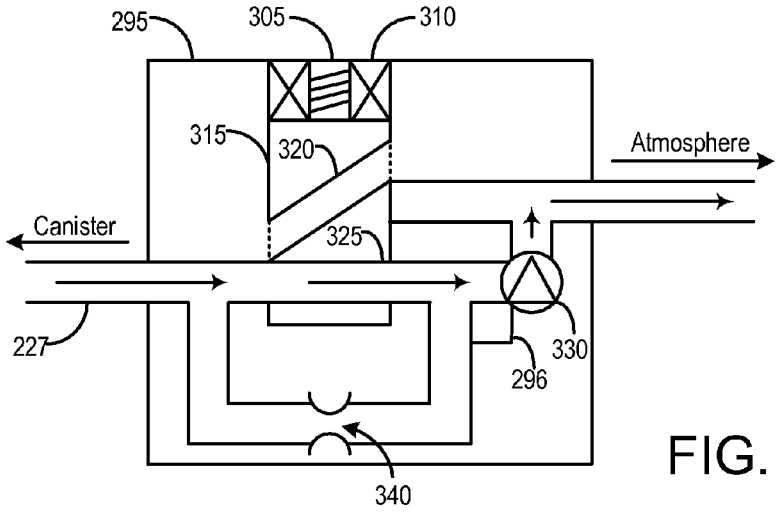
FIG. 3B shows a schematic depiction of an evaporative leak check module in a configuration to perform a fuel system evacuation leak check.
Figure 3C:
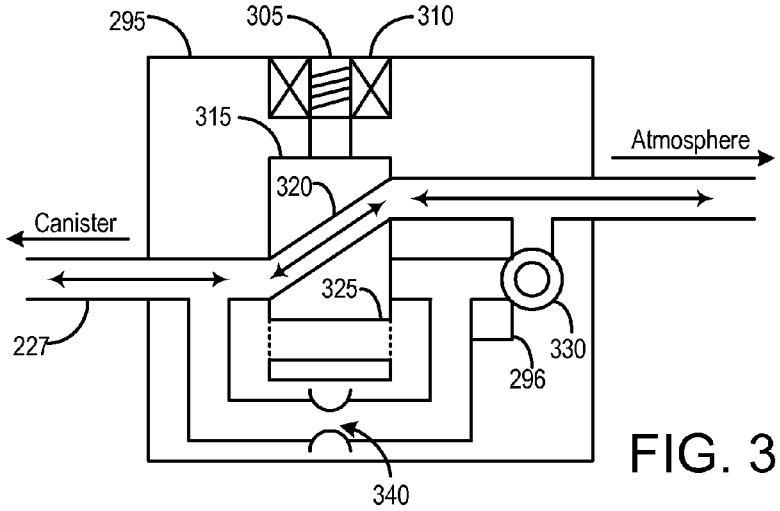
FIG. 3C shows a schematic depiction of an evaporative leak check module in a configuration to perform a purge operation.
Figure 4:
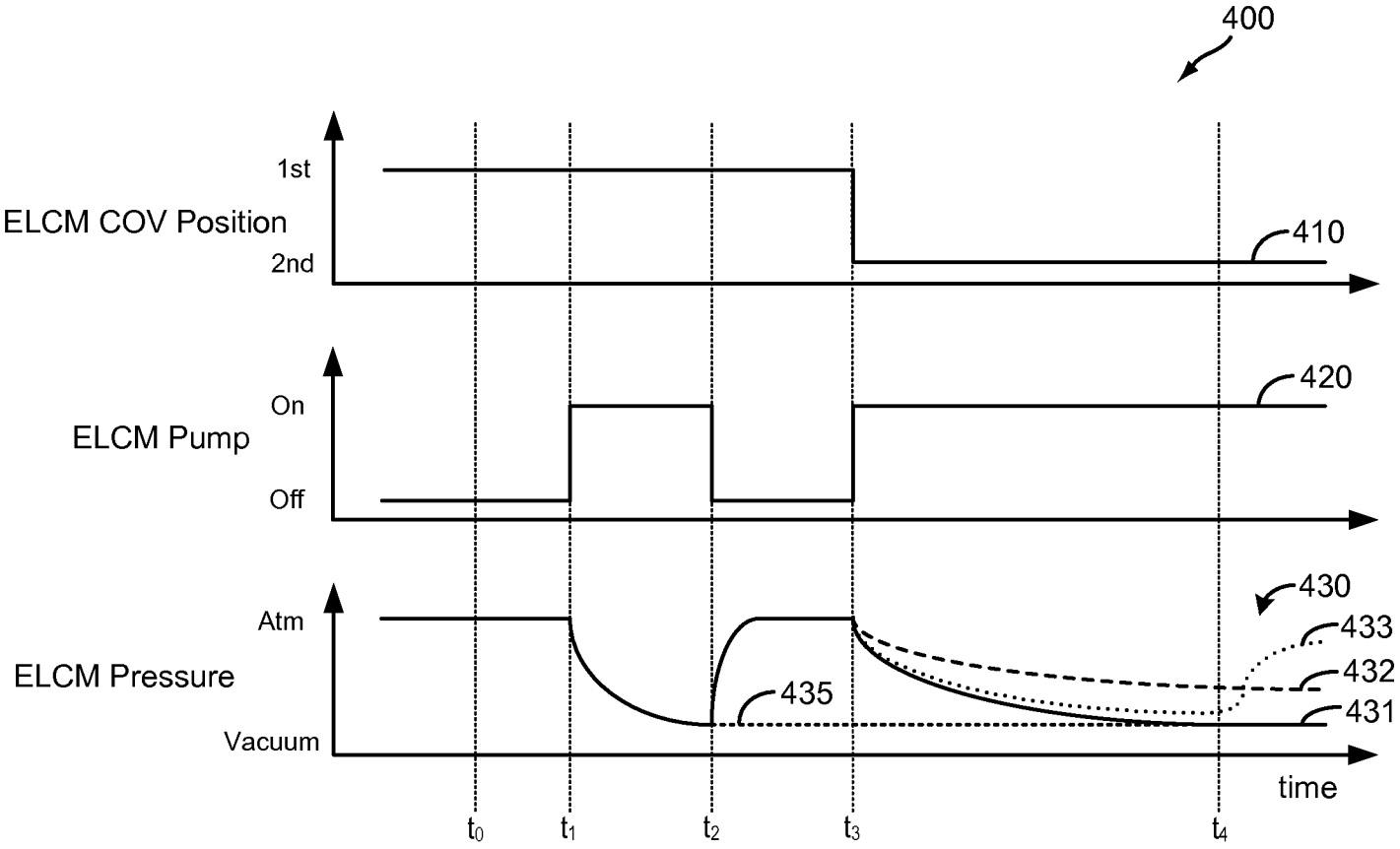
FIG. 4 shows a timeline for an example fuel system evacuation leak check using an evaporative leak check module.
Figure 5:
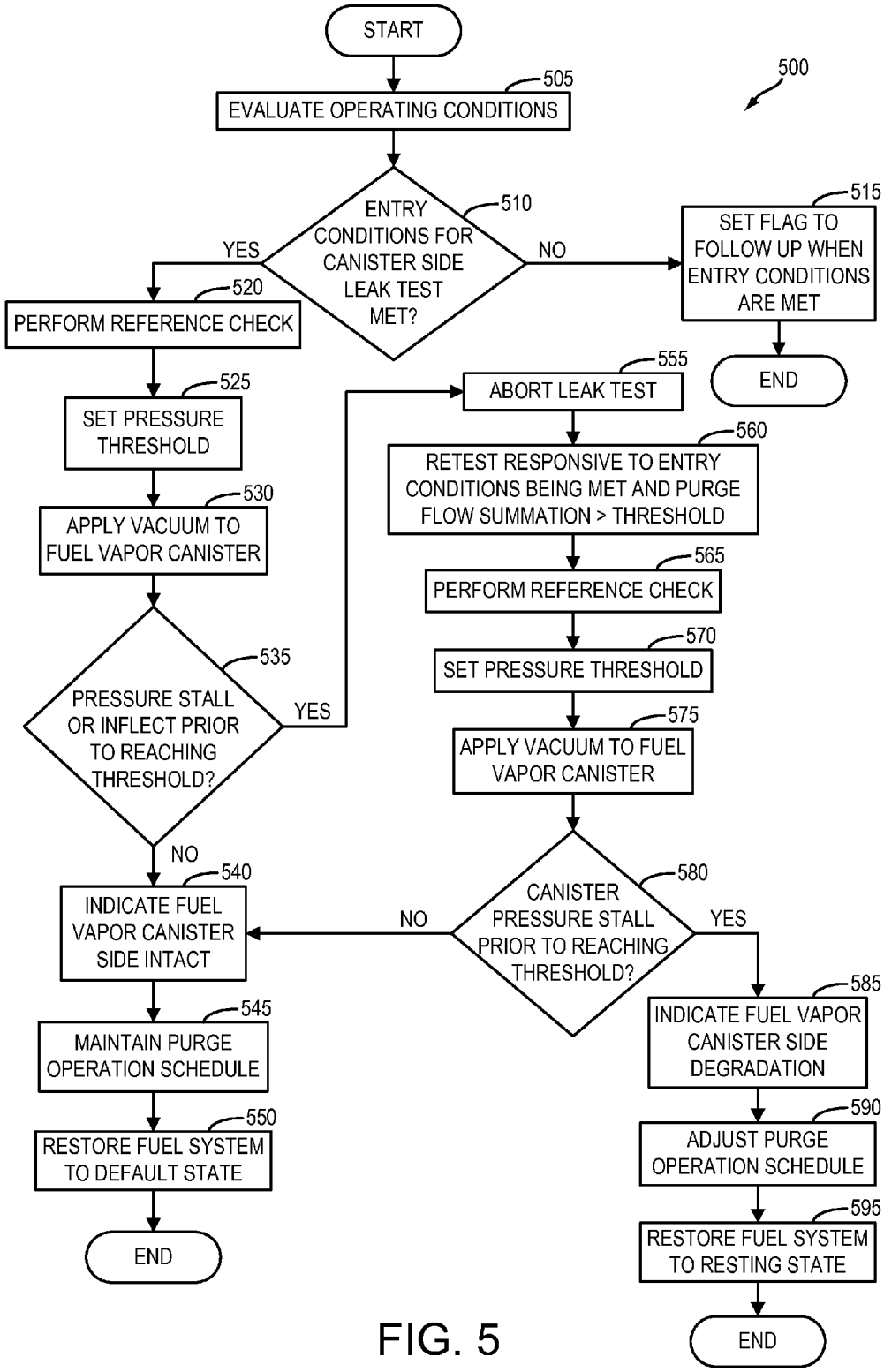
FIG. 5 shows a flow chart for an example high-level method for a fuel system evacuation leak check with reduced hydrocarbon emissions.
Figure 6:
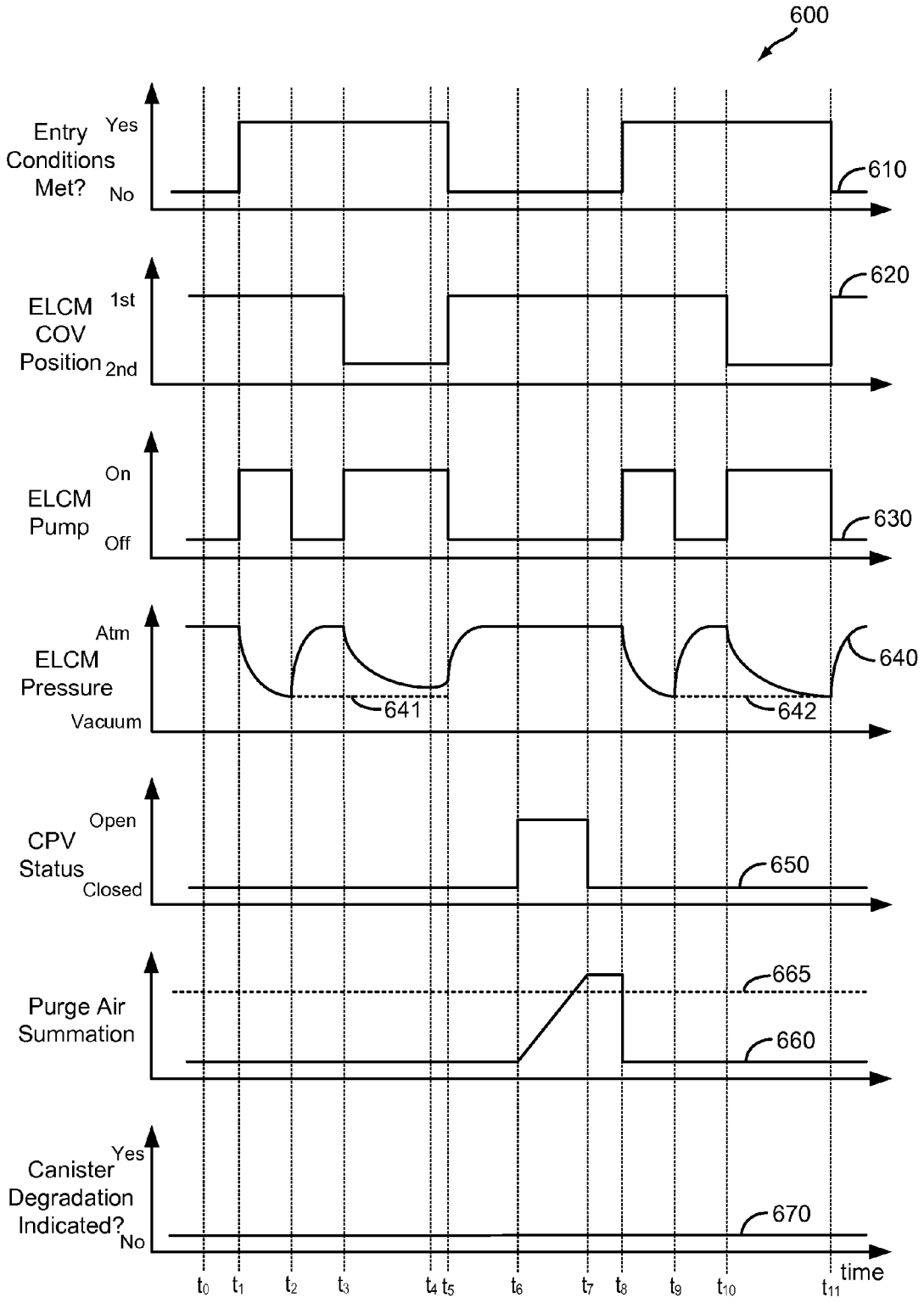
FIG. 6 shows a timeline for an example fuel system evacuation leak check using the method of FIG. 5.

The following description relates to systems and methods for reducing bleed emissions from a fuel vapor canister. In particular, the description relates to systems and methods for recognizing fuel vapor breakthrough from a fuel vapor canister during an evaporative leak check module based leak test of the fuel vapor canister, and aborting the leak test responsive to fuel vapor breakthrough without relying on a dedicated hydrocarbon sensor in the canister vent line. The fuel vapor canister may be included in a hybrid vehicle system, such as the hybrid vehicle system shown in FIG. 1. The fuel vapor canister may be configured to capture refueling vapors from a fuel tank, as shown in FIG. 2. The evaporative leak check module may be coupled to the fuel vapor canister and configured to draw a vacuum on the fuel vapor canister side of the evaporative emissions system, as shown in FIGS. 3A-3C. As shown in FIG. 4, hydrocarbon breakthrough from the fuel vapor canister may be indicated by an inflection point in the fuel vapor canister side pressure upon vacuum application. The emergence of hydrocarbons from the canister increases the work load of the evaporative leak check module, and may cause the vacuum to decay. Detecting hydrocarbon breakthrough in this fashion may result in the leak test being aborted and re-performed later, following fuel vapor canister purging, as indicated by the method shown in FIG. 5. An example timeline for such a leak test is shown in FIG. 6.

Figure 1:
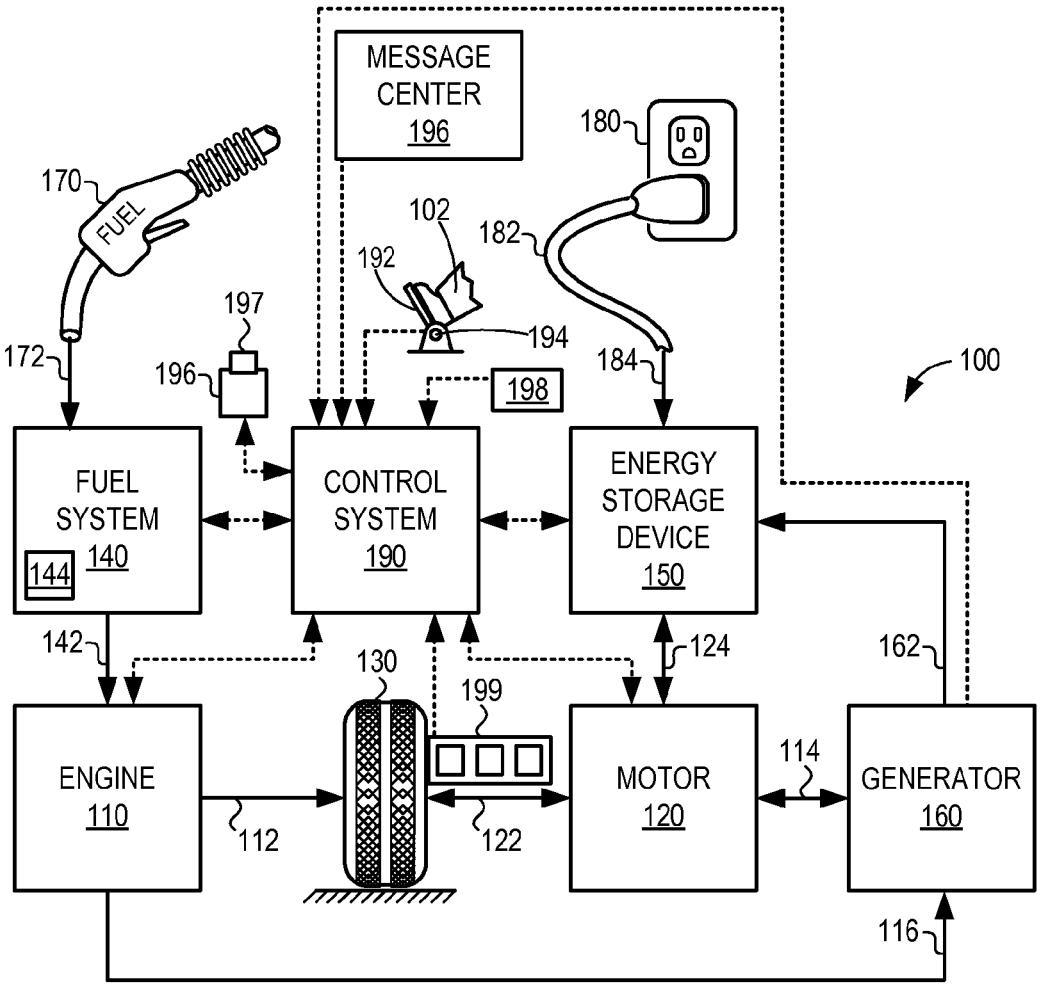
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Vehicle propulsion system 100 may be coupled within a vehicle system, such as vehicle system 206, as depicted schematically in FIG. 2. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system, including a motor, generator, energy storage device, etc. as shown for vehicle propulsion system 100.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve coupled within vent line 227. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. Conduit 278 may be fluidically coupled to vapor recovery line 231, and thus may be coupled to one or more of conduits 271, 273, and 275, either directly or indirectly. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291, and canister temperature sensor 243. Other sensors such as pressure, temperature, air/fuel ratio, and composition sensors may be coupled to various locations in the vehicle system 206. As another example, the actuators may include fuel injector 266, throttle 262, fuel tank isolation valve 253, pump 292, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 5.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 295 communicatively coupled to controller 212. ELCM 295 may be coupled in vent 227, between canister 222 and the atmosphere. ELCM 295 may include a vacuum pump for applying negative pressure to the fuel system when administering a leak test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed.

FIGS. 3A-3C show schematic depictions of example ELCM 295 in various conditions in accordance with the present disclosure. As shown in FIG. 2, ELCM 295 may be located along vent 227 between canister 222 and atmosphere. ELCM 295 includes a changeover valve (COV) 315, a pump 330, and a pressure sensor 296. Pump 330 may be a vane pump, for example. In some examples, pump 330 may be a reversible pump, and thus configured to pump air in a first or second direction. COV 315 may be moveable between a first a second position. In the first position, as shown in FIGS. 3A and 3C, air may flow through ELCM 295 via first flow path 320. In the second position, as shown in FIGS. 3B and 3D, air may flow through ELCM 295 via second flow path 325. The position of COV 315 may be controlled by solenoid 310 via compression spring 305 responsive to commands from controller 212. ELCM 295 may further comprise reference orifice 340. Reference orifice 340 may have a diameter corresponding to the size of a threshold leak to be tested, for example, 0.02". Regardless of whether COV 315 is in the first or second position, pressure sensor 296 may generate a pressure signal reflecting the pressure within ELCM 295. Operation of pump 330 and solenoid 310 may be controlled via signals received from controller 212.

As shown in FIG. 3A, COV 315 is in the first position, and pump 330 is activated in a first direction. Fuel tank isolation valve 252 (not shown) is closed, isolating ELCM 295 from the fuel tank. Air flow through ELCM 295 in this configuration is represented by arrows. In this configuration, pump 330 may draw a vacuum on reference orifice 340, and pressure sensor 296 may record the vacuum level within ELCM 295. This reference check vacuum level reading may then become the threshold for passing/failing a subsequent leak test.

As shown in FIG. 3B, COV 315 is in the second position, and pump 330 is activated in the first direction. This configuration allows pump 330 to draw a vacuum on fuel system 218 when CPV 261 is closed. In examples where fuel system 218 includes FTIV 252, FTIV 252 may be opened to allow pump 330 to draw a vacuum on fuel tank 220, or FTIV 252 may be closed to allow pump 330 to draw a vacuum on canister 222. Air flow through ELCM 295 in this configuration is represented by arrows. In this configuration, as pump 330 pulls a vacuum on fuel system 218, the absence of a leak in the system should allow for the vacuum level in ELCM 295 to reach or exceed the previously determined vacuum threshold. In the presence of a leak larger than the reference orifice, the pump will not pull down to the reference check vacuum level.

As shown in FIG. 3C, COV 315 is in the first position, and pump 330 is de-activated. This configuration allows for air to freely flow between atmosphere and the canister. This configuration may be used during a canister purging operation, for example. In some examples, this configuration may be used during a refueling event or in other scenarios where fuel vapor is being ported from the fuel tank to the fuel vapor canister. In this way, gasses stripped of fuel vapor may be vented from the fuel vapor canister to atmosphere.

Performing a reference check with an internal reference orifice allows a leak threshold to be set that compensates for environmental conditions. However, such a leak threshold is not compensated for the canister loading state. If the leak test occurs while the canister is saturated with hydrocarbons, and/or if there is considerable fuel vapor in the fuel tank (e.g., hot fuel, highly volatile fuel) the vacuum pump may evacuate both air and hydrocarbons. This may lead to a false fail result. An ELCM vacuum pump may be a constant low flow pump, with a flow rate of 1 L/minute, for example. As fuel vapor is heavier than air, the pump becomes less efficient with increased hydrocarbon content in the evacuated gas. The reference threshold may thus fail to be met in the time allotted for the test.

FIG. 4 shows a timeline 400 for an example fuel system evacuation leak check using an evaporative leak check module. Timeline 400 includes plot 410, indicating a position of an ELCM changeover valve (COV) over time. Timeline 400 further includes plot 420, indicating a status of an ELCM vacuum pump over time, and plot 430, indicating a pressure at the ELCM over time. Plot 430 includes 3 subplots, indicating separate scenarios. Subplot 431 indicates a pressure at the ELCM for an intact fuel system with an empty fuel vapor canister. Subplot 432 indicates a pressure at the ELCM for a degraded fuel system. Subplot 433 indicates a pressure at the ELCM for an intact fuel system with a saturated fuel system. Line 435 indicates a reference threshold for the leak check.

At time $t_0$, the ELCM COV is in the $1^{st}$ position (e.g., canister coupled to atmosphere, as shown in FIG. 3C) as shown by plot 410, and the ELCM pump is off, as shown by plot 420. Accordingly, the ELCM pressure is at atmospheric pressure, as indicated by plot 430.

At time $t_1$, a reference check begins. The ELCM COV is maintained in the $1^{st}$ position, while the ELCM pump is turned on (e.g., the configuration shown in FIG. 3A). Accordingly, a vacuum develops at the ELCM. At time $t_2$, the ELCM pressure reaches a plateau. This pressure is set as a reference threshold, as indicated by line 435. The ELCM pump is turned off, and the ELCM pressure equilibrates to atmospheric pressure.

At time $t_3$, the leak check begins. The ELCM COV is placed in the $2^{nd}$ position, while the ELCM pump is turned on (e.g., the configuration shown in FIG. 3B). Accordingly, a vacuum develops at the ELCM. For the system comprising an intact fuel system with an empty fuel vapor canister (subplot 431), the reference threshold indicated by line 435 is met at time $t_4$. For the degraded fuel system (subplot 432), the vacuum plateaus prior to the reference threshold. Subplot 432 indicates a pressure at the ELCM for a degraded fuel system. For the system comprising an intact fuel system with a saturated fuel vapor canister (subplot 433), the vacuum reaches an inflection point at time $t_4$, and then begins to decay towards atmospheric pressure. The inflection point corresponds with the breakthrough of hydrocarbons from the fuel vapor canister. Continuing to apply a vacuum to the fuel system in this scenario will result in hydrocarbon emission into the atmosphere. Further, as the reference threshold will not be met, the leak check will result in a false failure.

However, the inflection point in the ELCM pressure profile may thus be used to indicate hydrocarbon breakthrough and in turn, to abort the leak test. FIG. 5 shows a flow chart for a high-level method 500 for performing an evaporative emissions test on a fuel system using an evaporative leak check module. Instructions for carrying out method 500 and other methods included herein may be executed by a controller based on instructions stored in a non-transitory memory of the controller and in conjunction with signals received from sensors of the engine system, such as the sensors described above with reference to FIG. 1. The controller may employ engine actuators of the engine system to adjust engine operation, according to the methods described below. Method 500 will be described with regards to the systems described herein and depicted in FIGS. 1, 2, and 3A-3C, but it should be understood that similar methods may be applied to other systems without departing from the scope of this disclosure.

Method 500 begins at 505 by estimating operating conditions. Operating conditions may include ambient conditions, such as temperature, humidity, and barometric pressure, as well as vehicle conditions, such as engine operating status, fuel level, fuel tank pressure, fuel vapor canister load status, etc. Continuing at 510, method 500 includes determining whether the entry conditions are met for an ELCM-based, canister-side leak test. For example, entry conditions may include an engine-off condition, and/or an elapsed duration or number of engine-off events following a previous ELCM-based fuel system leak test. If entry conditions are not met, method 500 proceeds to 515. At 515, method 500 includes setting a flag to follow up at a subsequent key-off event, and/or when operating conditions favor a leak test, for example, at controller 212. Method 500 may further include maintaining the status of the vehicle fuel system. Method 500 may then end.

If entry conditions are met, method 500 proceeds to 520. At 520, method 500 includes performing an ELCM reference check. As discussed herein with regards to FIG. 3A, an ELCM reference check may comprise placing a COV in a first position and activating the ELCM vacuum pump. A pressure sensor, such as pressure sensor 296, may record the resulting vacuum level in the ELCM, after a certain amount of time, or when the vacuum level has reached a plateau.

Continuing at 525, method 500 includes using the recorded vacuum level at the end of the reference check as a basis for one or more thresholds to signify the expected vacuum attainable for a systemic leak with a diameter equivalent to the reference orifice. In some examples, the reference orifice has a diameter of 0.02", but may be smaller or greater in diameter in some embodiments. A vacuum threshold may be determined for the canister side of the emissions control system for a configuration where the FTIV and CPV are closed.

Continuing at 530, method 500 includes applying a vacuum to the fuel vapor canister. As discussed herein with regards to FIG. 3B, applying a vacuum to the fuel vapor canister may comprise opening a canister vent valve, closing (or maintaining closed) a canister purge valve, placing an ELCM COV in a second position, maintaining a FTIV closed, and activating (or maintaining active) an ELCM vacuum pump on. In this configuration, as the vacuum pump pulls a vacuum on the fuel vapor canister, the absence of a leak in the system should allow for the vacuum level at the ELCM to reach or exceed the previously determined vacuum threshold. In the presence of a leak larger than the reference orifice, the pump will not pull down to the reference check vacuum level.

Continuing at 535, method 500 includes determining whether the pressure at the ELCM stalls or inflects prior to reaching the reference vacuum threshold. As described with regard to FIG. 4, the pressure may plateau or inflect due to canister side degradation, or due to hydrocarbon breakthrough.

If the pressure at the ELCM does not stall or inflect prior to reaching the reference vacuum threshold (e.g., the pressure reaches the threshold) method 500 proceeds to 540. At 540, method 500 includes indicating the fuel vapor canister side of the fuel system is intact. Indicating the fuel system is intact may include recording the passing test result. Continuing at 545, method 500 includes maintaining the purge operation schedule. In some examples, method 500 may further include performing a leak check on the fuel tank side of the fuel system. Continuing at 550, method 500 includes restoring the fuel system to a default state. For example, the ELCM vacuum pump may be turned off, the ELCM COV placed in the 1$^{st}$ position, the CPV closed and the FTIV closed. Method 500 may then end.

Returning to 535, if the pressure at the ELCM stalls or inflects prior to reaching a threshold, method 500 proceeds to 555. At 555, method 500 includes aborting the leak test. Aborting the leak test may include turning the ELCM vacuum pump off and placing the ELCM COV in the 1$^{st}$ position. In some examples, the ELCM COV may be maintained in the 2$^{nd}$ position, and/or a canister vent valve may be closed to prevent hydrocarbon breakthrough to atmosphere. Degradation of the canister side of the fuel system may not be indicated. Rather, method 500 proceeds to 560, and includes retesting the canister side of the fuel system responsive to entry conditions being met and a purge flow summation being greater than a threshold. The purge flow summation threshold may be predetermined, or may be based on operating conditions, such as the canister load. The purge flow summation may include an integration of mass air flow through the fuel vapor canister. In this way, the retest is performed only after the fuel vapor canister load is below a threshold, thus removing hydrocarbon breakthrough as a possible reason for the pressure during the leak test plateauing or inflecting due to hydrocarbon breakthrough.

When the purge flow summation is greater than the threshold and other entry conditions for a canister side leak check are met, method 500 proceeds to 565. At 565, method 500 includes performing a reference check, as described with reference to 520. Continuing at 570, method 500 includes setting a pressure threshold, as described with reference to 525. Continuing at 575, method 500 includes applying a vacuum to the fuel vapor canister, as described with reference to 530.

Continuing at 580, method 500 includes determining whether the pressure at the ELCM stalls prior to reaching the reference threshold. If the pressure at the ELCM does not stall (or inflect) prior to reaching the reference vacuum threshold (e.g., the pressure reaches the threshold) method 500 proceeds to 540. At 540, method 500 includes indicating the fuel vapor canister side of the fuel system is intact, and continues as described herein.

If the pressure at the ELCM stalls (or inflects) prior to reaching the reference vacuum threshold, method 500 proceeds to 585. At 585, method 500 includes indicating fuel vapor canister side degradation. Indicating canister side degradation may include recording the occurrence of a failing test result, and may further include illuminating an MIL. Continuing at 590, method 500 may include adjusting purge operations. For example, scheduled purge operations may be suspended until the degradation is addressed. Other mitigating action may be taken by the controller, such as suspending refueling operations. Continuing at 595, method 500 may include restoring the fuel system to a resting state. Restoring the fuel system to a resting state may include turning off the ELCM vacuum pump, and placing the ELCM COV in a first position. Restoring the fuel system may further include opening a canister vent valve (if closed), and closing a canister purge valve (if open). Method 500 may then end.

FIG. 6 shows an example timeline 600 for a leak test on an emissions control system utilizing an ELCM in a vehicle equipped with a fuel vapor canister, using the method described herein and with regards to FIG. 5 as applied to the system described herein and with regards to FIGS. 1, 2, and 3A-C. Timeline 600 includes plot 610, indicating whether entry conditions are met for a leak test over time. Timeline 600 further includes plot 620, indicating a position of an ELCM COV over time; plot 630, indicating a status of an ELCM pump over time; and plot 640, indicating a pressure at the ELCM over time. Lines 641 and 642 indicate leak test vacuum thresholds based on ELCM reference checks. Timeline 600 further includes plot 650, indicating a status of a CPV over time, and plot 660, indicating a purge air summation over time. Line 665 indicates a purge air summation threshold. Timeline 600 further includes plot 670, indicating whether canister degradation is indicated over time. The FTIV may be assumed closed throughout the timeline.

At time $t_0$, the fuel system is in a resting state. As such, the CPV is closed, as shown by plot 650. The ELCM COV is in the 1$^{st}$ position, as shown by plot 620, and the ELCM pump is off, as shown by plot 630. At time $t_1$, entry conditions for a leak test are met, as shown by plot 610. Accordingly, the ELCM pump is activated, while the ELCM COV is maintained in the first position. As discussed herein and with regard to FIG. 3A, in this conformation, the ELCM may perform a reference check that compensates for humidity, temperature, and barometric pressure.

The reference check proceeds from time $t_1$ to time $t_2$. The canister side pressure decreases, as measured by the ELCM pressure sensor and shown by plot 640. At time $t_2$, the reference check is completed. A threshold vacuum is set for leak testing the fuel vapor canister side of the fuel system (line 641). The fuel system may then be placed in conformation for leak testing the fuel vapor canister side. The CPV is maintained closed. The ELCM pump is turned off. Accordingly the canister pressure returns to atmospheric pressure at time $t_3$. At time $t_3$, the ELCM COV is placed in the 2$^{nd}$ position. As described herein and with regards to FIG. 3B, in this conformation, the ELCM vacuum pump may draw a vacuum on the fuel vapor canister. The ELCM vacuum pump is then activated. A vacuum is drawn on the fuel vapor canister from time $t_3$ to time $t_5$. At time $t_4$, the vacuum reaches an inflection point, and the vacuum begins to decay to atmospheric pressure. Accordingly, at time $t_5$, the ELCM is turned off, and the ELCM COV is placed in the first position. However, canister degradation is not indicated, as shown by plot 670.

At time $t_6$, canister purge conditions are met. Accordingly, the CPV is opened, and the purge air summation increases as air flows through the canister desorbing bound hydrocarbons, as indicated by plot 660. The purge event ends at time $t_7$, and the CPV is closed. The purge air summation is greater than the threshold indicated by line 665, and thus that entry condition for repeating the leak check is satisfied. At time $t_8$, all entry conditions for repeating the canister side leak check are satisfied, as indicated by plot 610. Accordingly, the ELCM pump is activated, while the ELCM COV is maintained in the first position. The reference check proceeds from time $t_8$ to time $t_9$. The canister side pressure decreases, as measured by the ELCM pressure sensor. At time $t_9$, the reference check is completed. A threshold vacuum is set for re-testing the fuel vapor canister side of the fuel system (line 642). The fuel system may then be placed in conformation for leak testing the fuel vapor canister side. The CPV is maintained closed. The ELCM pump is turned off. Accordingly the canister pressure returns to atmospheric pressure at time $t_{10}$. At time $t_{10}$, The ELCM COV is placed in the 2$^{nd}$ position. As described herein and with regards to FIG. 3B, in this conformation, the ELCM vacuum pump may draw a vacuum on the fuel vapor canister. The ELCM vacuum pump is then activated. A vacuum is drawn on the fuel vapor canister from time $t_{10}$ to time $t_{11}$. At time $t_{11}$, the canister side vacuum reaches the threshold indicated by line 642. Accordingly, canister degradation is not indicated, as shown by plot 670. The ELCM vacuum pump is turned off, and the ELCM COV is returned to the 1$^{st}$ position.

The systems described herein and with regard to FIGS. 1, 2, and 3A-3C, along with the method described herein and with reference to FIG. 5 may enable one or more systems and one or more methods. In one example, a method for a fuel system is provided, comprising applying a vacuum to a fuel vapor canister side of the fuel system, and indicating hydrocarbon breakthrough responsive to a fuel vapor canister side pressure inflection point indicative of a decay in fuel vapor canister side vacuum. In this way, an evaporative leak check module may perform a leak check on a fuel vapor canister, and hydrocarbon breakthrough from the fuel vapor canister may be indicated without requiring a dedicated hydrocarbon sensor in the canister vent line. Such a method may additionally or alternatively comprise ceasing applying a vacuum to the fuel vapor canister side responsive to the fuel vapor canister side pressure inflection point. In examples where the method includes ceasing applying the vacuum to the fuel vapor canister side, the method may additionally or alternatively comprise, responsive to a purge flow summation greater than a threshold, setting a reference threshold for a fuel vapor canister side leak test. In examples where the method includes setting a reference threshold, the method may additionally or alternatively comprise, following setting a reference threshold for a fuel vapor canister side leak test, re-applying a vacuum to the fuel vapor canister side of the fuel system. In examples where the vacuum is re-applied, the method may additionally or alternatively comprise, responsive to a fuel vapor canister side pressure reaching a plateau prior to reaching the reference threshold, indicating degradation of the fuel vapor canister side of the fuel system. In examples where degradation is indicated, the method may additionally or alternatively comprise adjusting a fuel vapor canister purge operation schedule based on the indicated degradation. In examples where the vacuum is reapplied, the method may additionally or alternatively comprise, responsive to a fuel vapor canister side pressure reaching the reference threshold, indicating the fuel vapor canister side of the fuel system is intact. In any of the preceeding examples, the method may additionally or alternatively comprise, prior to applying a vacuum to the fuel vapor canister side, setting a reference threshold for a fuel vapor canister side leak test. In examples where a reference threshold is set for a fuel vapor canister side leak test, the method may additionally or alternatively comprise, responsive to a fuel vapor canister side pressure reaching a plateau prior to reaching the reference threshold, ceasing applying a vacuum to the fuel vapor canister side, and indicating to re-apply a vacuum to the fuel vapor canister side responsive to a purge flow summation greater than a threshold. In examples where a vacuum is re-applied, the method may additionally or alternatively comprise, indicating degradation of the fuel vapor canister side of the fuel system responsive to a fuel vapor canister side pressure plateauing prior to reaching a reference threshold upon vacuum re-application. In examples where a vacuum is re-applied, the method may additionally or alternatively comprise, responsive to a fuel vapor canister side pressure reaching the reference threshold upon vacuum re-application, indicating the fuel vapor canister side of the fuel system is intact. In examples where the fuel vapor canister side of the fuel system is indicated to be intact, the method may additionally or alternatively comprise maintaining a fuel vapor canister purge operation schedule responsive to the indication of an intact fuel vapor canister side of the fuel system. The technical result of applying such methods is that leak tests may be performed on a fuel vapor canister side of an emissions control system without causing hydrocarbon breakthrough emissions.

In another example, a fuel system for a vehicle is provided, comprising a fuel vapor canister coupled to an engine intake via a canister purge valve, a fuel tank coupled to the fuel vapor canister via a fuel tank isolation valve, an evaporative leak check module coupled between the fuel vapor canister and atmosphere, a pressure sensor coupled to the evaporative leak check module, and a controller configured with instructions stored in non-transitory memory, which, when executed, cause the controller to: close the fuel tank isolation valve and the canister purge valve, at the evaporative leak check module, determine a reference threshold indicative of fuel vapor canister degradation, at the evaporative leak check module, apply a vacuum to the fuel vapor canister, responsive to a fuel vapor canister pressure reaching a plateau or inflection point prior to reaching the reference threshold, indicating to re-test the fuel vapor canister responsive to a purge flow summation greater than a threshold. In this way, leak test false failures stemming from hydrocarbon breakthrough can be eliminated. In such an example, the controller may additionally or alternatively be configured with instructions stored in non-transitory memory, which, when executed, cause the controller to: indicate degradation of the fuel vapor canister responsive to a fuel vapor canister pressure plateauing prior to reaching a reference threshold upon re-testing. In any of the preceding examples, the controller may additionally or alternatively be configured with instructions stored in non-transitory memory, which, when executed, cause the controller to: responsive to a fuel vapor canister side pressure reaching the reference threshold upon re-testing, indicate that the fuel vapor canister is intact. In any of the preceding examples, the purge air flow summation may additionally or alternatively be based on an amount of atmospheric air drawn through the fuel vapor canister and into the engine intake. In any of the preceding examples, the purge air flow summation threshold may additionally or alternatively be based on a load of the fuel vapor canister. The technical result of implementing such fuel systems is a decrease in leak test false failures, thus leading to a leak test with increased robustness.

In yet another example, a method for an evaporative emission system is provided, comprising, determining a reference threshold indicative of degradation of a fuel vapor canister side of the evaporative emissions system, applying a vacuum to a fuel vapor canister side, responsive to a fuel vapor canister side pressure reaching a plateau or inflection point prior to reaching the reference threshold, indicating to re-apply a vacuum to the fuel vapor canister side responsive to a purge flow summation greater than a threshold, and not indicating degradation of the fuel vapor canister side responsive to the fuel vapor canister side pressure reaching a plateau or inflection point prior to reaching the reference threshold. In this way, hydrocarbon breakthrough, which may decrease the efficiency of a vacuum pump, will not be falsely indicated as a fuel vapor canister side leak. In such an example, the method may additionally or alternatively comprise indicating degradation of the fuel vapor canister side responsive to the fuel vapor canister side pressure plateauing prior to reaching a reference threshold upon re-applying a vacuum to the fuel vapor canister side of the evaporative emissions system. In any of the preceeding examples, the method may additionally or alternatively comprise indicating the fuel vapor canister side of the evaporative emissions system is intact responsive to a fuel vapor canister side pressure reaching the reference threshold upon re-applying a vacuum to the fuel vapor canister side of the evaporative emissions system. The technical result of implementing this method is a reduction in hydrocarbon emissions without requiring a dedicated hydrocarbon sensor in the canister vent line to detect hydrocarbon breakthrough during an evaporative emissions leak test.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a fuel system, comprising:

applying a vacuum to a fuel vapor canister side of the fuel system;

responsive to a fuel vapor canister side pressure inflection point indicative of a decay in fuel vapor canister side vacuum, indicating hydrocarbon breakthrough; and responsive to the fuel vapor canister side pressure reaching a plateau prior to reaching a reference threshold, indicating hydrocarbon breakthrough.

2. The method of claim 1, further comprising:

ceasing applying the vacuum to the fuel vapor canister side responsive to the fuel vapor canister side pressure inflection point.

3. The method of claim 2, further comprising:
responsive to a purge flow summation greater than a threshold, setting a reference threshold for a fuel vapor canister side leak test.

4. The method of claim 3, further comprising:
following setting the reference threshold for the fuel vapor canister side leak test, re-applying the vacuum to the fuel vapor canister side of the fuel system.

5. The method of claim 1, further comprising:
adjusting a fuel vapor canister purge operation schedule based on indicated degradation.

6. The method of claim 1, further comprising:
responsive to the fuel vapor canister side pressure reaching the reference threshold, indicating the fuel vapor canister side of the fuel system is intact.

7. The method of claim 1, further comprising:
prior to applying the vacuum to the fuel vapor canister side, setting a reference threshold for a fuel vapor canister side leak test.

8. A method for a fuel system, comprising:
applying a vacuum to a fuel vapor canister side of the fuel system;
responsive to a fuel vapor canister side pressure inflection point indicative of a decay in the fuel vapor canister side vacuum;
prior to applying the vacuum to the fuel vapor canister side, setting a reference threshold for a fuel vapor canister side leak test;
responsive to a fuel vapor canister side pressure reaching a plateau prior to reaching the reference threshold, ceasing applying the vacuum to the fuel vapor canister side; and
indicating to re-apply the vacuum to the fuel vapor canister side responsive to a purge flow summation greater than a threshold.

9. The method of claim 8, further comprising:
indicating degradation of the fuel vapor canister side of the fuel system responsive to the fuel vapor canister side pressure plateauing prior to reaching the reference threshold upon vacuum re-application.

10. The method of claim 8, further comprising:
responsive to the fuel vapor canister side pressure reaching the reference threshold upon vacuum re-application, indicating the fuel vapor canister side of the fuel system is intact.

11. The method of claim 10, further comprising:
maintaining a fuel vapor canister purge operation schedule responsive to the indication of the intact fuel vapor canister side of the fuel system.

12. A fuel system for a vehicle, comprising:
a fuel vapor canister coupled to an engine intake via a canister purge valve;
a fuel tank coupled to the fuel vapor canister via a fuel tank isolation valve;
an evaporative leak check module coupled between the fuel vapor canister and atmosphere;
a pressure sensor coupled to the evaporative leak check module; and
a controller configured with instructions stored in non-transitory memory, which, when executed, cause the controller to:
close the fuel tank isolation valve and the canister purge valve;
at the evaporative leak check module, determine a reference threshold indicative of fuel vapor canister degradation;
at the evaporative leak check module, apply a vacuum to the fuel vapor canister;
responsive to a fuel vapor canister pressure reaching a plateau, indicating to re-test the fuel vapor canister responsive to a purge flow summation greater than a threshold; and
responsive to a fuel vapor canister pressure inflection point prior to reaching the reference threshold, indicating to re-test the fuel vapor canister responsive to the purge flow summation greater than the threshold.

13. The fuel system of claim 12, wherein the controller is further configured with instructions stored in non-transitory memory, which, when executed, cause the controller to:
indicate degradation of the fuel vapor canister responsive to the fuel vapor canister pressure plateauing prior to reaching the reference threshold upon re-testing.

14. The fuel system of claim 12, wherein the controller is further configured with instructions stored in non-transitory memory, which, when executed, cause the controller to:
responsive to a fuel vapor canister side pressure reaching the reference threshold upon re-testing, indicate that the fuel vapor canister is intact.

15. The fuel system of claim 12, wherein the purge flow summation is based on an amount of atmospheric air drawn through the fuel vapor canister and into the engine intake.

16. The fuel system of claim 12, wherein the purge flow summation threshold is based on a load of the fuel vapor canister.

17. A method for an evaporative emissions system, comprising:
determining a reference threshold indicative of degradation of a fuel vapor canister side of the evaporative emissions system;
applying a vacuum to the fuel vapor canister side;
responsive to a fuel vapor canister side pressure reaching a plateau or inflection point prior to reaching the reference threshold, indicating to re-apply the vacuum to the fuel vapor canister side responsive to a purge flow summation greater than a threshold; and
not indicating degradation of the fuel vapor canister side responsive to the fuel vapor canister side pressure reaching the plateau or inflection point prior to reaching the reference threshold.

18. The method of claim 17, further comprising:
indicating degradation of the fuel vapor canister side responsive to the fuel vapor canister side pressure plateauing prior to reaching the reference threshold upon re-applying the vacuum to the fuel vapor canister side of the evaporative emissions system.

19. The method of claim 17, further comprising:
indicating the fuel vapor canister side of the evaporative emissions system is intact responsive to the fuel vapor canister side pressure reaching the reference threshold upon re-applying the vacuum to the fuel vapor canister side of the evaporative emissions system.

* * * * *